US006821145B1

(12) United States Patent
Pollock et al.

(10) Patent No.: US 6,821,145 B1
(45) Date of Patent: Nov. 23, 2004

(54) HERMETICALLY SEALED CONNECTOR AND METHODS OF PROVIDING THE SAME

(75) Inventors: John A. Pollock, Wilton, NH (US); Anthony DeSantis, New Boston, NH (US)

(73) Assignee: Special Hermetic Products, Inc., Wilton, NH (US)

( * ) Notice: Subject to any disclaimer, the term of this patent is extended or adjusted under 35 U.S.C. 154(b) by 0 days.

(21) Appl. No.: 10/620,992

(22) Filed: Jul. 16, 2003

(51) Int. Cl.[7] ..... H01R 13/73
(52) U.S. Cl. ..... 439/559; 439/935
(58) Field of Search ..... 439/559, 935, 439/548

(56) References Cited

U.S. PATENT DOCUMENTS 2,688,737 A * 9/1954 Oskerka, Jr. et al. ..... 439/935
3,597,716 A * 8/1971 Stuart et al. ..... 439/935
3,685,005 A * 8/1972 D'Alessandro ..... 439/935
4,174,145 A * 11/1979 Oeschger et al. ..... 439/935
5,041,019 A * 8/1991 Sharp et al. ..... 439/935

* cited by examiner

*Primary Examiner*—Tho D. Ta
(74) *Attorney, Agent, or Firm*—Hayes Soloway PC

(57) ABSTRACT

A hermetically sealed connector and method for providing the same is provided. Generally, the connector contains a header having a series of pins secured therein, wherein the header has an upper portion that extends in a direction perpendicular to a central axis of a pin within the series of pins. The header also has a lower lip portion that extends in a direction perpendicular to the upper lip portion. The connector also contains an outer body having a series of clearance layers therein that are defined by an inner wall of the outer body, wherein each clearance layer within the series of clearance layers has an associated diameter, and wherein the header is connected to a first portion of the inner wall via a solder joint that extends from the lower lip portion of the header to the first portion of the inner wall. The first portion of the inner wall also has at least two different diameters.

21 Claims, 5 Drawing Sheets

FIG. 7
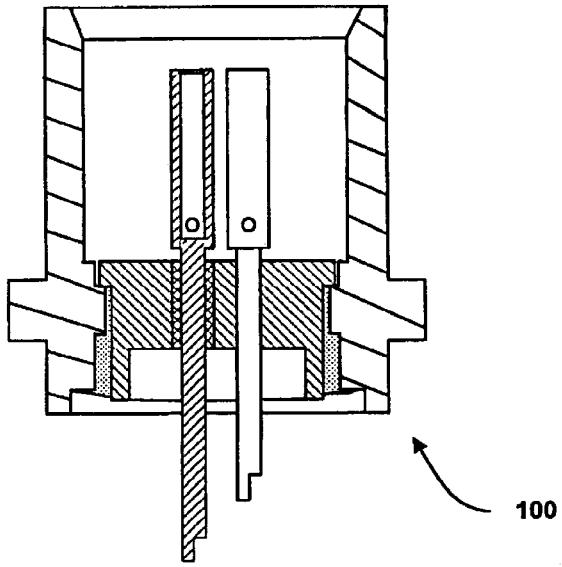
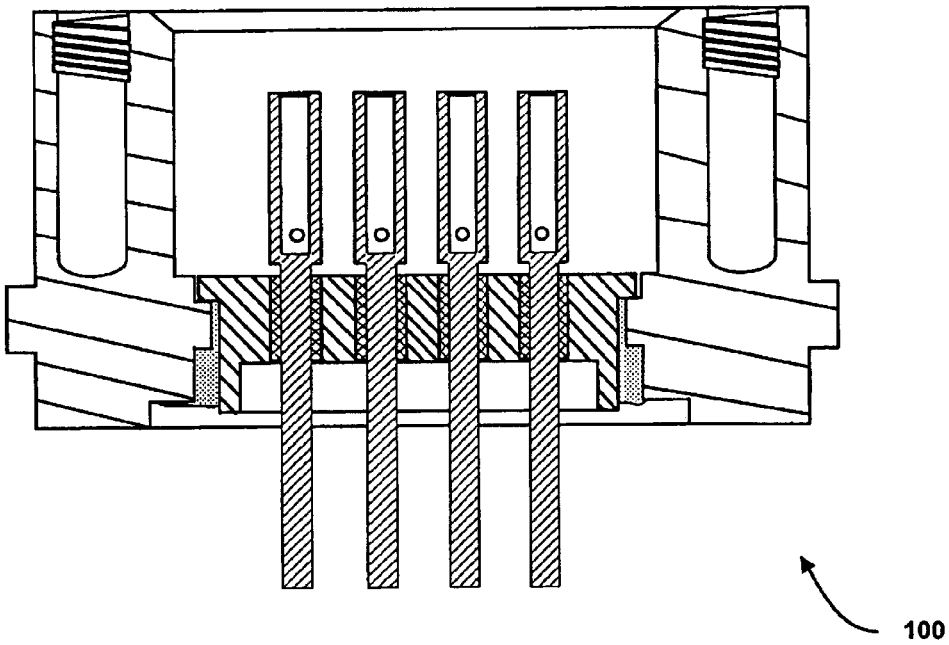
FIG. 8

HERMETICALLY SEALED CONNECTOR AND METHODS OF PROVIDING THE SAME

FIELD OF THE INVENTION

The present invention is generally related to hermetically sealed devices, and more particularly is related to a hermetically sealed connector.

BACKGROUND OF THE INVENTION

Electrical connectors (hereafter referred to as "connectors") are typically utilized to provide signal transmission between multiple devices. Alternatively, connectors may be utilized to provide signal transmission within a single device. With advancement in technology, connectors have been utilized in many different environments, including, but not limited to, use in space, where logic associated with the connector is required to be enclosed in an air-tight body. As an example, it is typical that the connector is mounted directly to a housing. In the above example, the connection between the housing and the connector is required to be hermetically sealed to protect the logic from corrosive gases and/or moisture that may exist in the environment. In this case, the portion of the connector mounted to the housing is required to be hermetic and provide for reliable hermetic attachment to the housing.

Current solutions to the abovementioned include use of individual feed-thrus to achieve a hermetically wired conventional non-hermetic connector, or use of connectors constructed with bimetallic composites, the former being expensive in terms of material cost, labor and space, and the latter simply being expensive.

It should also be noted that structurally, a typical connector contains multiple pins connected within a header, where the header is connected to an outer body. The outer body is situated within the housing. Typically, the header is connected to the outer body via soldering techniques. Unfortunately, a seal between the header and the outer body may fail due to failures in a soldering joint between the header and the outer body. Soldering a minimal clearance joint between the header and the outer body results in a very thin layer of solder. While a thin layer of solder exhibits great strength in certain contexts and types of testing, it does not provide for significant radial compliance in the configuration described above. Accordingly, when the connector is subjected to temperature cycling, as is required in the testing of many military components, the solder joint may become fatigued and fail. In addition, the solder joint may not fail during testing, but instead, may fail during use of the connector. This tendency to failure is exacerbated by the well-known tendency of solder to creep under stress.

Thus, a heretofore unaddressed need exists in the industry to address the aforementioned deficiencies and inadequacies.

SUMMARY OF THE INVENTION

Embodiments of the present invention provide a hermetically sealed connector and method for providing the same. Briefly described, in architecture, one embodiment of the connector, among others, can be implemented as follows. The connector contains a header having a series of pins secured therein, wherein the header has an upper lip portion that extends in a direction perpendicular to a central axis of a pin within the series of pins. The header also has a lower lip portion that extends in a direction perpendicular to the upper lip portion. The connector also contains an outer body having a series of clearance layers therein that are defined by an inner wall of the outer body, wherein each clearance layer within the series of clearance layers has an associated diameter, and wherein the header is connected to a first portion of the inner wall via a solder joint that extends from the lower lip portion of the header to the first portion of the inner wall. The first portion of the inner wall also has at least two different diameters.

The present invention can also be viewed as providing methods for providing a hermetically sealed connector. In this regard, one embodiment of such a method, among others, can be broadly summarized by the following steps: placing a header within an outer body, wherein the header has a series of pins secured therein, an upper lip portion that extends in a direction perpendicular to a central axis of a pin within the series of pins, and a lower lip portion that extends in a direction perpendicular to the upper lip portion, and wherein the outer body has an inner wall defined by a first clearance layer having a first diameter, a second clearance layer having a second diameter, and a third clearance layer having a third diameter, wherein the first diameter is smaller than the second diameter, and the second diameter is smaller than the third diameter, the step of placing the header within the outer body resulting in a first step defined by a first space located between the header and the first clearance layer, a second step defined by a second space located between the header and the second clearance layer, and a third step defined by a third space located between the header and the third clearance layer; and filling the second step and the first step with solder.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

FIG. 7 is a schematic diagram illustrating a cross-sectional side view of the connector, in accordance with the first exemplary embodiment of the invention.

FIG. 8 is a schematic diagram illustrating a cross-sectional front view of the connector of FIG. 7.

DETAILED DESCRIPTION

For exemplary purposes, the following describes a hermetically sealed micro D connector and method of providing the same. It should be noted, however, that alternative hermetically sealed connectors may be provided in accordance with the present invention. In fact, the present invention is not intended to be limited to micro D connectors, but instead, is intended to include different connectors where a solder joint between a header (described below) and an outer body (described below) is as close to fail-safe as possible.

Specifically, the present invention provides a connector and method of providing the same, where design and fabrication of the connector results in a cost effective, highly reliable hermetic multi-pin connector through use of properly selected materials and use of compliant solder joints.

Figure 1:
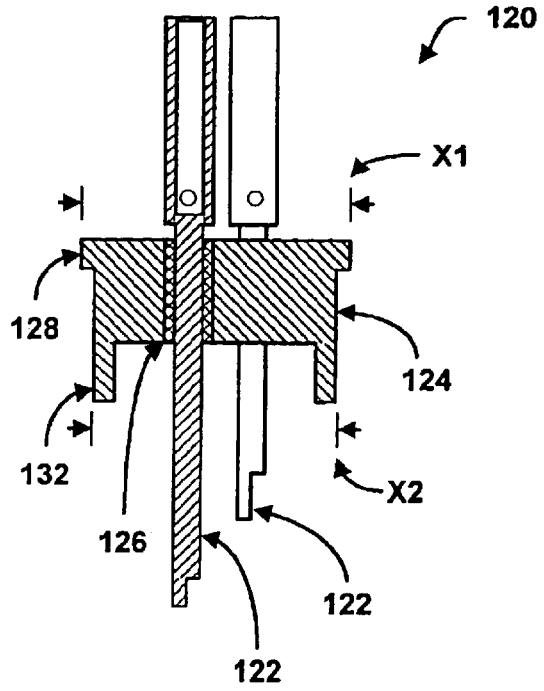
FIG. 1 is a schematic diagram illustrating a cross-sectional side view of a header of the connector, in accordance with the first exemplary embodiment of the invention.

In accordance with a first exemplary embodiment of the invention, the present connector 100 contains a header 120 (FIG. 1) and an outer body 140 (FIG. 3), each of which is described in detail below with reference to FIG. 1–FIG. 9. Referring to FIG. 1, FIG. 1 is a schematic diagram illustrating a cross-sectional side view of the header 120 of the connector 100, in accordance with the first exemplary embodiment of the invention. As is shown by FIG. 1, the header 120 has a series of connector pins 122 therein, two of which are shown for exemplary purposes. It should be noted that two connector pins 122 are shown in FIG. 1 due to two layers of connector pins 122 being provided within the connector 100. Of course, more, or fewer rows of connector pins 122 may be provided within the connector 100. In addition, more, or fewer, connector pins 122 may be located within the connector 100. Examples of numbers of connector pins 122 that may be located within the connector 100 include, but is not limited to, nine (9), fifteen (15), twenty one (21), twenty five (25), thirty one (31), thirty seven (37), and fifty one (51) connector pins 122. Of course, more, or fewer, connector pins 122 may be located within the connector 100.

Preferably, each connector pin 122 is bonded within a header body 124 via use of a glass-like insulating material 126 that is fused to both the connector pin 122 and the header body 124, thereby forming a hermetic seal. Bonding techniques for forming the hermetic seal via use of the glass-like insulating material 126 are well known to those having ordinary skill in the art and are therefore not described in greater detail herein. It should be noted that the glass-like insulating material 126 may have a glass ceramic composition, or any glass-like dielectric material.

The header body 124 is preferably constructed of steel, specifically a low carbon steel. Alternatively, the header body 124 may be constructed of kovar or stainless steel. In addition, the header body 124 may be constructed by utilizing explosively generated bi-metallics, which comprise two desired materials that are joined molecularly by implosive techniques. Of course, other metals may be used for the header body 124, however, it is desirable that a coefficient of thermal expansion of the metal utilized for the header body 124 be reasonably close to the coefficient of thermal expansion of outer body material (described below), thereby minimizing the strain on connector solder joints (explained below).

As is shown by FIG. 1, the header 120 has an upper lip portion 128 that extends horizontally from a central portion of the header 120, in a direction perpendicular to a central axis of one of the connector pins 122. The header 120 also has a lower lip portion 132 that extends vertically from the central portion of the header 120, in a direction parallel to the central axis of one of the connector pins 122. It should be noted that a first diameter X1 of the header 120 along the upper lip portion 128 (hereafter referred to as the "first diameter X1") is larger than a second diameter X2 of the header 120 along the lower lip portion 132 (hereafter referred to as the "second diameter X2"). As an example, the first diameter X1 of the header 120 may be 0.012 inch larger than the second diameter X2 of the header 120. The difference in diameter between the first diameter X1 and the second diameter X2 provides for sufficient overlap with an outer body inner diameter Y3 (described below), thereby providing required structural support for the header 120. Of course, the first diameter X1 may be more, or less, than 0.012 inch larger than the second diameter X2.

Figure 2:
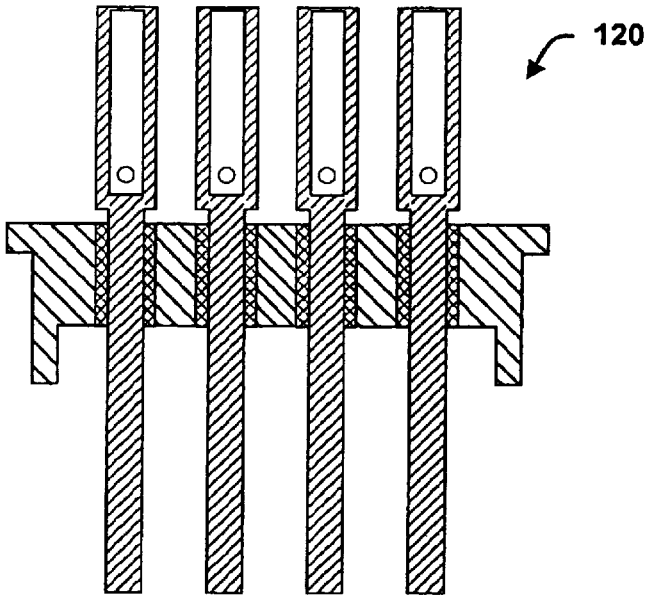
FIG. 2 is a schematic diagram illustrating a cross-sectional front view of the header of FIG. 1.

FIG. 2 is a schematic diagram illustrating a cross-sectional front view of the header 120 of FIG. 1. Since the header 120 has been described in detail above, the header 120 is not described again herein.

Figure 3:
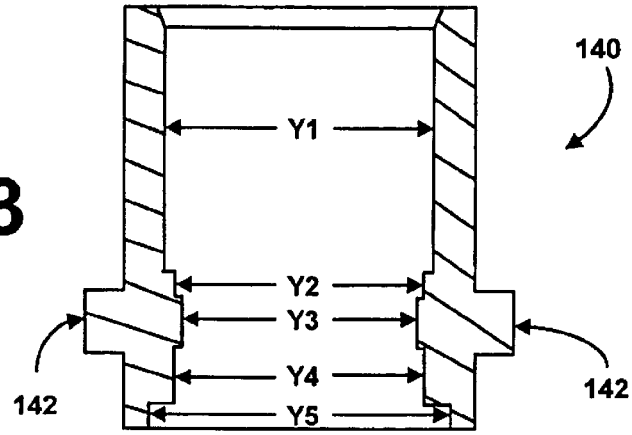
FIG. 3 is a schematic diagram illustrating a cross-sectional side view of the outer body of the connector, in accordance with the first exemplary embodiment of the invention.

FIG. 3 is a schematic diagram illustrating a cross-sectional side view of the outer body 140 of the connector 100, in accordance with the first exemplary embodiment of the invention. The outer body 140 of the connector 100 is preferably made of a material having a coefficient of thermal expansion that is reasonably close to the coefficient of thermal expansion of a receptacle housing when soldering (explained below). Thermal strain within the connector 100 is minimized by ensuring that the coefficient of thermal expansion of material utilized to construct the header 120 is reasonably close to the coefficient of thermal expansion of material utilized to construct the outer body 140. Minimizing thermal strain adds additional fatigue life to a solder joint (described below) between the header 120 and the outer body 140 since, due to coefficients of thermal expansion, both portions of the connector 100 have similar expansion properties.

Examples of material that may be used to construct the outer body 140 includes, but is not limited to, aluminum (e.g., 6061 aluminum, or 4047 aluminum), stainless steel, or may be brass or copper, provided that the material is compatible to the attachment method used to attach the outer body 140 to an outer housing (explained below).

As is shown by FIG. 3, an inner portion of the outer body 140 of the connector 100, as defined by an inner wall, is shaped so as to have several layers of clearance within the inner portion, wherein the layers of clearance have different widths or diameters. It should be noted that although the inner portion of the outer body 140 has several layers of clearance having different diameters, the outer body 140 is preferably fabricated as a solid portion of the connector 100 and not several separate layers that are connected. A first clearance layer of the outer body 140 has a first diameter Y1; a second clearance layer has a second diameter Y2; a third clearance layer has a third diameter Y3; a fourth clearance layer has a fourth diameter Y4; and a fifth clearance layer has a fifth diameter Y5.

Each of the abovementioned diameters of the clearance layers have a specific purpose, as is described immediately hereafter. The first clearance layer diameter Y1 is sized to accept a mating connector that will connect to the connector pins 122 (FIG. 1). The second clearance layer diameter Y2 is large enough to allow the upper lip portion 128 (FIG. 1) of the header 120 (FIG. 1) to reside therein, thereby laterally locating the header 120 (FIG. 1). Specifically, diameter of the upper lip portion 128 (FIG. 1) of the header 120 (FIG. 1) is slightly smaller than the second clearance layer diameter Y2. Preferably, the difference in diameter between the upper lip portion 128 (FIG. 1) and the second clearance layer diameter Y2 is on the order of 0.001 to 0.002 inch, and provides a small channel which may retain solder seepage as a result of possible seepage of solder during soldering of the header 120 (FIG. 1) to the outer body 140. Specifically, the small channel functions as an out gas release during soldering. The difference in diameter between the upper lip portion 128 (FIG. 1) of the header 120 (FIG. 1) and the second clearance layer diameter Y2 of the outer body 140 allows the header 120 (FIG. 1) to be placed within the outer body 140, during construction of the connector 100, wherein the upper lip portion 128 (FIG. 1) of the header 120 (FIG. 1) is situated within the portion of the inner wall of the outer body 140 that defines the second clearance layer diameter Y2.

It should be noted that, after, or during, assembly of the connector 100, the upper lip portion 128 (FIG. 1) of the header 120 (FIG. 1) rests on a top of a portion of the outer body 140 that extends inwardly within the inner portion of the outer body 140 to create the third clearance layer diameter Y3. This is better shown by FIG. 5, which is described in detail below.

The third clearance layer diameter Y3, fourth clearance layer diameter Y4, and fifth clearance layer diameter Y5 are progressively larger than the second diameter X2 of the header 120 (FIG. 1), thereby providing an open space having three steps of clearance, respectively, between the outer body 140 and the header body 124 (FIG. 1). As an example, a first step of clearance between the outer body 140 and the header body 124 (FIG. 1) may be approximately 0.007 inch in length; a second step of clearance between the outer body 140 and the header body 124 (FIG. 1) may be approximately 0.012 inch in length; and a third step of clearance between the outer body 140 and the header body 124 (FIG. 1) may be approximately 0.031 inch in length. It should be noted that these measurements may be larger or smaller. In addition, in accordance with an alternative embodiment of the invention, the outer body 140 may instead have four clearance layer diameters, where only two steps of clearance are provided between the outer body 140 and the header body 124 (FIG. 1). Further, in accordance with another alternative embodiment of the invention, the outer body 140 may instead have six or more clearance layer diameters, where four or more steps of clearance are provided between the outer body 140 and the header body 124 (FIG. 1).

When the first step of clearance between the outer body 140 and the header body 124 (FIG. 1) is filled with solder, as described below, a maximally complaint solder joint (also referred to herein as the first step solder joint) that measures approximately 0.007 inch in width is created between the outer body 140 and the header body 124 (FIG. 1). Such a solder thickness provides a maximally compliant solder joint to headers up to approximately 0.500 inch in length or diameter. Unfortunately, a thinner solder joint, e.g., less than 0.001 inch, would fail under thermal cycling, therefore having the solder joint on the order of 0.007 inch is preferable, although exactly 0.007 inch is not required. The addition of the second layer of solder (as explained below) having a thickness of approximately 0.012 inch enables the solder joint to be maximally compliant to headers up to approximately 1.00 inch in length or diameter. Of course, larger layers of solder may be used to accommodate larger headers. It should be noted that portions of the connector 100 and receiving housing (mentioned below) are preferably treated (e.g., electroplated) to allow for soldering.

In addition, when the second step of clearance between the outer body 140 and the header body 124 (FIG. 1) is filled with solder, as described below, the second step solder joint is almost twice as thick as the first step solder joint. It should be noted that the second step solder joint receives approximately half the amount of strain received by the first step solder joint. Having the second step solder joint in addition to the first step solder joint adds additional resilience to the solder, thereby minimizing strain of the solder and resulting in a more fatigue resistant hermetic seal between the outer body 140 and the header body 124 (FIG. 1).

The third step of clearance between the outer body 140 and the header body 124 (FIG. 1) functions as a reservoir for melted solder that is not drawn to create the first step solder joint and the second step solder joint. In addition, the lower lip portion 132 of the header 120 keeps the melted solder within the third step of clearance between the outer body 140 and the header body 124 (FIG. 1), and also protects the connector pins 122 from seepage of the melted solder.

Figure 9:
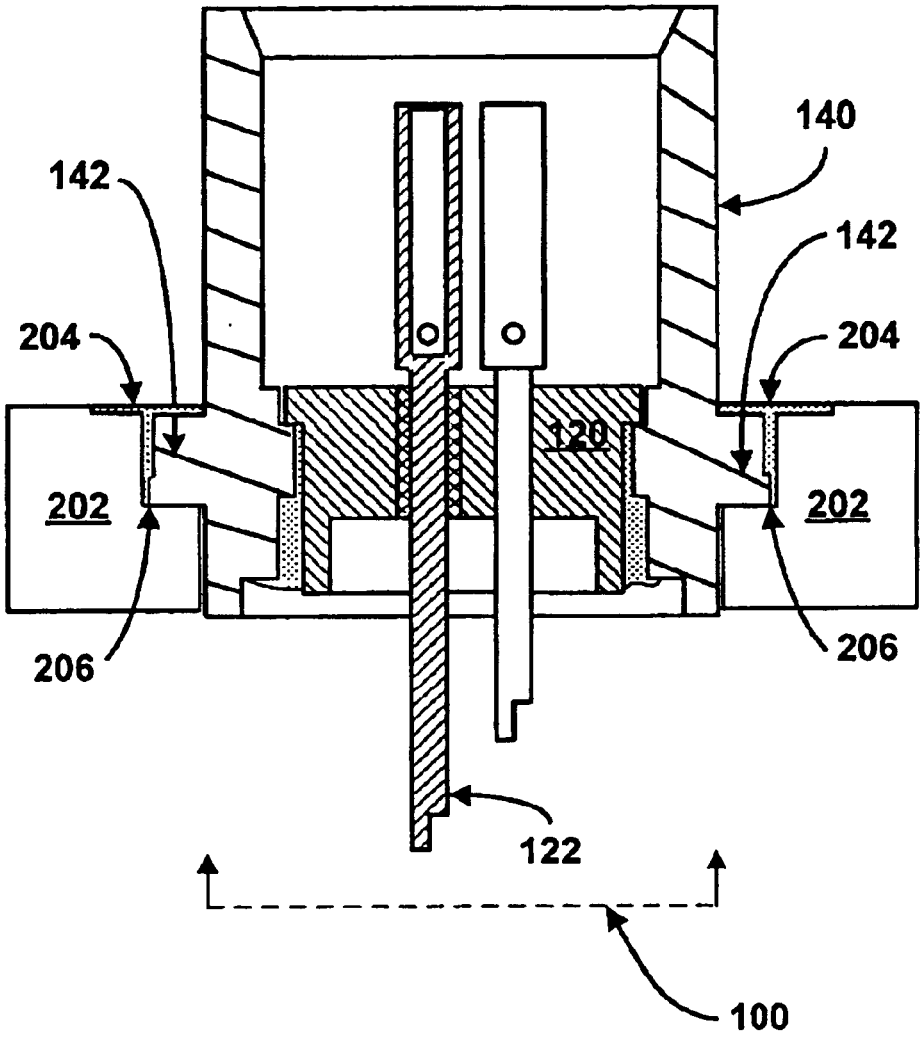
FIG. 9 is a schematic diagram illustrating connection of the connector to a receiving housing via use of compliant solder joints.

The outer body 140 of the connector 100 also has an outer lip portion 142 that allows the connector 100 to be attached to a receiving housing of a device that utilizes the connector 100. FIG. 9 shows an example of the connector 100 soldered to a receiving housing 202. Further, disclosure with reference to FIG. 9 is provided hereinbelow.

Figure 4:
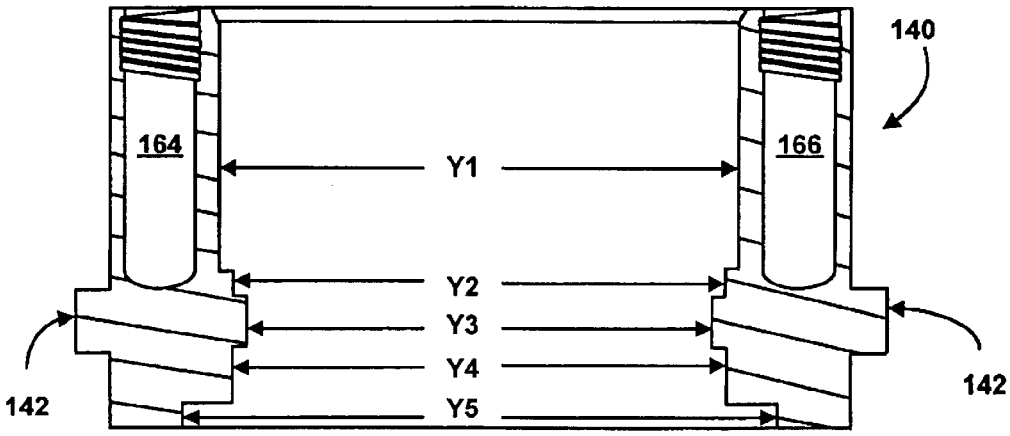
FIG. 4 is a schematic diagram illustrating a cross-sectional front view of the outer body of the connector of FIG. 3.

FIG. 4 is a schematic diagram illustrating a cross-sectional front view of the outer body 140 of the connector of FIG. 3. As is shown by FIG. 4, the outer body 140 also contains a first groove 164 and a second groove 166 for receiving a screw or other fastening device, thereby providing a means for connecting a device, such as, but not limited to, a plug, to the connector 100.

It should be noted that shape and size of the outer body 140 may differ in accordance with use of the connector 100. As an example, the outer body 140 may be entirely in an oval shape without having an outer lip portion 142. In addition, the outer body 140 may not have a first groove 164 and a second groove 166 for allowing connection to the connector 100, but may have no attachment device as in the case of a rack and panel arrangement. Alternatively, a clamp may be utilized to connect to the connector 100, thereby alleviating the need for grooves 164, 166 within the outer body 140. In addition, the connector 100 might be round in form and may contain threads as a means of holding a mating connector.

Figure 5:
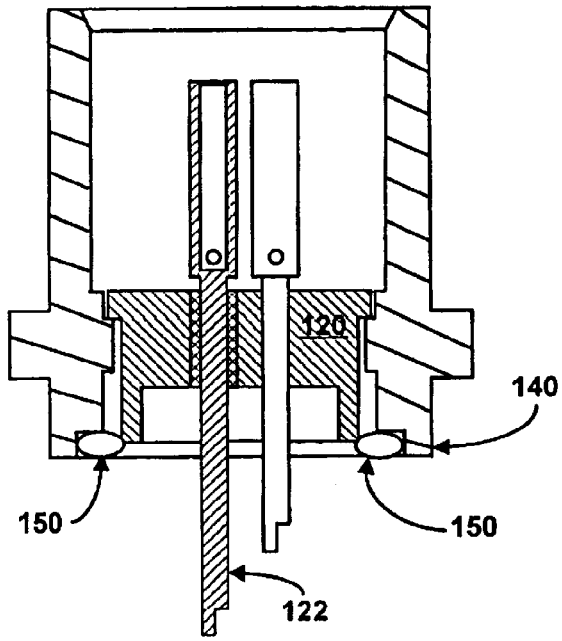
FIG. 5 is a schematic diagram illustrating a cross-sectional side view of the outer body of the connector, having the header of FIG. 1 therein and a ring-like annular solder preform therebetween.
Figure 6:
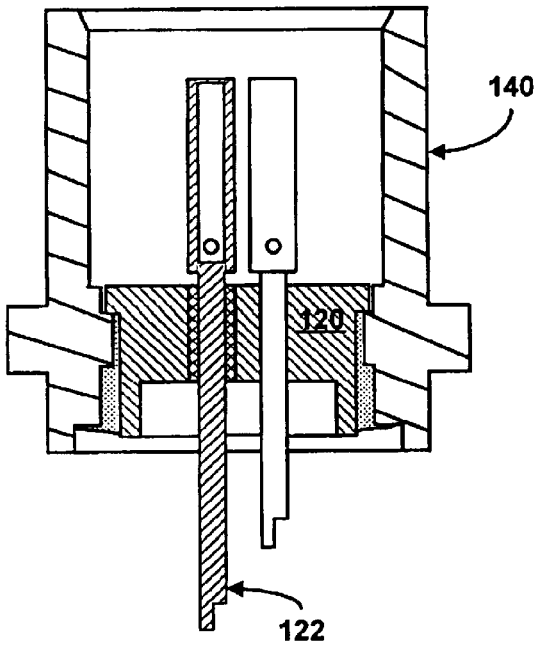
FIG. 6 is a schematic diagram illustrating a cross-sectional side view of the outer body of the connector, having the header of FIG. 1 therein and melted solder therebetween.

FIG. 5 is a schematic diagram illustrating a cross-sectional side view of the outer body 140 of the connector 100, having the header 120 of FIG. 1 therein and a ring-like annular solder preform 150 there-between. Upon heating the solder preform 150 melts and is drawn, by capillary action, into the third step of clearance, the second step of clearance, and then the first step of clearance between the outer body 140 and the header 120. FIG. 6 is a schematic diagram illustrating a cross-sectional side view of the outer body 140 of the connector 100, having the header 120 of FIG. 1 therein and melted solder there-between.

FIG. 7 is a schematic diagram illustrating a cross-sectional side view of the hermetically sealed connector 100 after assembly, in accordance with the first exemplary embodiment of the invention. Alternatively, FIG. 8 is a schematic diagram illustrating a cross-sectional front view of the hermetically sealed connector 100 of FIG. 7.

The connector 100 may be connected to a receiving housing 202, or receptacle, located within a device that utilizes the connector 100. FIG. 9 is a schematic diagram illustrating connection of the connector 100 to a receiving housing 202 via use of compliant solder joints. As is shown by FIG. 9, the connector 100 may be connected to the receiving housing 202 via a vertical solder joint 206. A nonfunctional horizontal solder joint 204, which is a preform well, resides upon a top portion of the receiving housing 202, while the vertical solder joint 206 resides upon a side portion of the receiving housing 202. Specifically, the outer lip portion 142 of the outer body 140 is connected to an inner portion of the receiving housing 202 via the vertical solder joint 206. The horizontal solder joint 204 is a perform well that may gather overflowing solder left from filling the vertical solder joint 206.

While filling the vertical solder joint 206 a second horizontal solder joint (not shown) may form, which has a minimal thickness that approaches zero. This second horizontal solder joint may connect an inner portion of the receiving housing 202 to a bottom portion of the outer lip portion 142. Unfortunately, when there is differential expansion of the receiving housing 202 and/or the outer body 140, the second horizontal solder joint may crack.

The vertical solder joint 206 connects a side portion of the receiving housing 202 to a side portion of the outer body 140. As is shown by FIG. 9, the vertical solder joint 206 may have more than one diameter. As an example, FIG. 9 shows that the vertical solder joint 206 contains two steps having two different diameters. The larger of the two steps provides an effective solder joint between the receiving housing 202 and the outer body 140. In fact, the result of soldering via use of the vertical solder joint 206 is a hermetic seal between the outer body 140 and the receiving housing 202.

It should be noted that when the outer body material is appropriately chosen to be compatible with the receptacle housing material, the connector 100 may be connected to the receiving housing 202 via alternative methods, such as, but not limited to, laser welding. Laser welding provides a hermetic seal between the receiving housing 202 and the outer body 140. Alternatively, the connector 100 may be connected to the receiving housing 202 via different methods, such as, but not limited to, welding via different methods.

It should be emphasized that the above-described embodiments of the present invention are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

What is claimed is:

1. A connector, comprising:

a header having a series of pins secured therein, wherein said header has an upper lip portion that extends in a direction perpendicular to a central axis of a pin within said series of pins, said header also having a lower lip portion that extends in a direction perpendicular to said upper lip portion; and an outer body having a series of clearance layers therein that are defined by an inner wall of said outer body, wherein each clearance layer within said series of clearance layers has an associated diameter, and wherein said header is connected to a first portion of said inner wall via a solder joint that extends from said lower lip portion of said header to said first portion of said inner wall, said first portion of said inner wall having at least one diameter.

2. The connector of claim 1, wherein said first portion of said inner wall has at least two different diameters.

3. The connector of claim 2, wherein said series of pins are secured within said header via a glass-like insulating material that forms a hermetic seal between said header and said series of pins.

4. The connector of claim 2, where said header and said outer body are fabricated from at least one metal, and wherein said header and said outer body have similar coefficients of thermal expansion.

5. The connector of claim 2, wherein said first portion of said inner wall is further defined by a first clearance layer having a first diameter, a second clearance layer having a second diameter, and a third clearance layer having a third diameter, wherein said first diameter is smaller than said second diameter, and said second diameter is smaller than said third diameter.

6. The connector of claim 5, wherein said inner wall further comprises a second portion and a third portion, said second portion of said inner wall and said upper lip defining a small gap that is capable of receiving said solder, and said third portion being large enough to receive a mating connector.

7. The connector of claim 6, wherein said small gap is approximately 0.001 to 0.002 inch in width.

8. The connector of claim 5, wherein a first space located between said header and said first clearance layer defines a first step, a second space located between said header and said second clearance layer defines a second step, and a third space located between said header and said third clearance layer defines a third step, said first step and said second step being filled with said solder to create said solder joint.

9. The connector of claim 8, wherein said second step has a width that is approximately double a width of said first step, thereby having solder located therein receive approximately half of strain received by solder located within said first step.

10. The connector of claim 2, wherein said outer body further comprises a connecting means.

11. The connector of claim 10, wherein said connecting means is a first groove and a second groove, for allowing a first screw and a second screw to fit therein.

12. The connector of claim 2, wherein said connector is connected to a housing.

13. The connector of claim 12, wherein said connector is connected to said housing by soldering via a vertical solder joint having two widths.

14. The connector of claim 12, wherein said connector is connected to said housing by laser welding.

15. A method for providing a hermetically sealed connector, comprising the steps of:

placing a header within an outer body, wherein said header has a series of pins secured therein, an upper lip portion that extends in a direction perpendicular to a central axis of a pin within said series of pins, and a lower lip portion that extends in a direction perpendicular to said upper lip portion, and wherein said outer body has an inner wall defined by a first clearance layer having a first diameter, a second clearance layer having a second diameter, and a third clearance layer having a third diameter, wherein said first diameter is smaller than said second diameter, and said second diameter is smaller than said third diameter, said step of placing said header within said outer body resulting in a first step defined by a first space located between said header and said first clearance layer, a second step defined by a second space located between said header and said second clearance layer, and a third step defined by a third space located between said header and said third clearance layer; and filling said second step and said first step with solder.

16. The method of claim 15, further comprising the step of allowing said solder to solidify, thereby providing a hermetically sealed connector.

17. The method of claim 15, wherein said method results in a small gap being created between said a second portion of said inner wall and said upper lip of said header.

18. The method of claim 17, wherein said small gap is approximately 0.001 to 0.002 inch in width.

19. The method of claim 15, further comprising the step of connecting said connector to a housing.

20. The method of claim 19, wherein said connector is connected to said housing via soldering.

21. The method of claim 19, wherein said connector is connected to said housing via laser welding.

* * * * *

UNITED STATES PATENT AND TRADEMARK OFFICE

CERTIFICATE OF CORRECTION

PATENT NO. : 6,821,145 B1
DATED : November 23, 2004
INVENTOR(S) : Pollock et al.

It is certified that error appears in the above-identified patent and that said Letters Patent is hereby corrected as shown below:

Title page,
Item [75], Inventors, "US" should read -- Canada --.
Item [57], ABSTRACT,
Line 4, after "upper" insert -- lip --.

Signed and Sealed this

Eleventh Day of October, 2005

JON W. DUDAS
*Director of the United States Patent and Trademark Office*